United States Patent [19]

Keable

[11] Patent Number: 4,612,875

[45] Date of Patent: Sep. 23, 1986

[54] FILM COATER

[75] Inventor: John B. Keable, Kettering, Ohio

[73] Assignee: QMI Corporation, Centerville, Ohio

[21] Appl. No.: 715,447

[22] Filed: Mar. 25, 1985

[51] Int. Cl.[4] ..... B05C 1/08; B05C 11/02

[52] U.S. Cl. ..... 118/670; 118/680; 118/676; 118/118; 118/32; 118/642; 118/223; 118/225

[58] Field of Search ..... 118/642, 32, 118, 119, 118/680, 223, 225, 226, 224, 670, 676, 677, 247, 669

[56] References Cited

U.S. PATENT DOCUMENTS

| | | | |
|---|---|---|---|
| 2,199,228 | 4/1940 | Obenshain et al. | 118/223 X |
| 2,383,964 | 9/1945 | Grupe | 118/118 X |
| 2,748,015 | 5/1956 | Speed et al. | 118/670 X |
| 2,933,417 | 4/1960 | McIntyre, Jr. | 118/118 X |
| 2,961,336 | 11/1960 | Uhleen | 118/118 X |
| 3,066,046 | 11/1962 | Walton | 118/227 X |
| 3,304,910 | 2/1967 | Warner | 118/118 X |
| 3,916,043 | 10/1975 | Fowble | 427/294 |
| 3,930,464 | 1/1976 | Wallstén | 118/122 |
| 4,122,218 | 10/1978 | Boström et al. | 427/209 |
| 4,231,318 | 11/1980 | Zink | 118/122 |
| 4,274,748 | 6/1981 | Burtin et al. | 356/431 |
| 4,447,468 | 5/1984 | Keable | 427/54.1 |

FOREIGN PATENT DOCUMENTS

| | | | |
|---|---|---|---|
| 942522 | 2/1949 | France | 118/670 |

OTHER PUBLICATIONS

Encyclopedia of Chemical Technology, Third Edition, John Wiley & Sons, pp. 790–791 (not dated).

*Primary Examiner*—John P. McIntosh

*Attorney, Agent, or Firm*—Biebel, French & Nauman

[57] ABSTRACT

A coater applies ultraviolet curable coating material to the opposite sides of roll film by a double-sided coater which employs offset coating rolls and smoothing bars. A splice detector responds to the occurrence of a splice upstream of the coater and causes the splice region to move through the coater without applying coating material to the splice region, by lifting the emulsion side of the film off of the coating roll as the splice passes and by interrupting the operation of the smoothing bars and the offset applicator roller on the non-emulsion or base side, concurrently with the passage of the splice therepast.

6 Claims, 6 Drawing Figures

FILM COATER

BACKGROUND OF THE INVENTION

This application relates to photographic film coating apparatus, and more particularly to apparatus for applying protective coating to the surfaces of roll film, such as 35 millimeter processed film strips or other strip film material.

It is known that ultraviolet curable coating materials of the kinds described in the patents of Nozarre, U.S. Pat. No. 4,049,861 issued Sept. 20, 1977 and Lien et al, U.S. Pat. No. 4,146,046 issued May 22, 1979, have particular advantage as an abrasion-resistant coating for photographic films. Such protective coating materials are marketed in the United States by Minnesota Mining and Manufacturing Company under the trade name 3M Photogard and consist of an optically clear protective coating which is highly resistant to abrasion, to static electricity, to fingerprints, and to a wide variety of solvents.

In the photographic processing industry, it is common to assembly processed films, such as strips of color negative material, in serial or end-to-end relation, joined by paper splices, and wound as a roll on a spool, for unwinding and delivery to a printer. Commonly, such film come in various lengths, such as 36 exposure, 24 exposure, 20 exposure lengths, etc., which are then connected end to end by paper splicers so that a large number of such films, for example, negatives, can be handled for printing at one time. However, the film may consist of 100 foot lengths of microfilm material or 1,000 or 2,000 foot reels of motion picture film. Commonly, the paper splices connecting the adjacent ends of the strips, are applied to the emulsion sides of the films to the leader or trailing ends of the films beyond the image areas, and after the completion of the processing, including the printing where desired, the strips are again severed for packaging and return to the individual customer.

It has been found highly advantageous to apply a ultraviolet curable hard coating to such film of the general kind described above, and it not only reduces the likelihood of scratching of the film, but also reduces dust, makes fingerprints easy to wipe off, reduces static electricity which attracts dust and dirt, and otherwise protects and preserves the film. Further, such coating has been found to provide enhanced printing qualities to the film.

There is therefore a need for a relatively low cost simple and yet effective apparatus for applying protective coating to spools or reels of film, curing such coating, and returning the film to a take-up reel for subsequent processing, such as printing. It has been found that it is undesirable to coat the film with protective coating material in the region of the splices. Coating the splices adds an undesirable thickness or buildup in that region. More importantly, however, is the fact that the coating material tends to be absorbed by the splice or at least accumulated in the region of tne splice, and frequently does not cure within the time allotted for the curing of the coating on the remaining portion of the film. Therefore, it has been necessary in the past from time to time to insert interleaf papers manually at the splice region where the splice occurs during the respooling or rewinding operation, to prevent the adjacent turn or layer of film from contacting the uncured or wet coating at the splice region. For this reason, there also exists a need to provide for automatic splice detection and control apparatus by means of which the splice is caused to pass through the coater without the accumulation of any appreciable coating in the splice region, and thereafter automatically to reestablish coating following the passage of the splice.

SUMMARY OF THE INVENTION

This invention is directed to a roll film type coater and more particularly to apparatus for simultaneously coating the opposite sides of a roll of strip film material with an ultraviolet curable hard coating material. In another aspect of the invention, a splice detector is provided for signalling the passage of a paper splice, including control apparatus for interrupting momentarily the application of coating material to the splice region as the splice moves through the coater.

The apparatus of the present invention, in its broader aspects, includes a spindle on which a spool or reel of the film may be mounted. The film from the reel is directed through an accumulator, in the form of an elevator or festoon, to a double sided coater, which applies a measured quantity of ultraviolet curable coating material to the opposite sides of the film. From the coater, the film passes through an ultraviolet curing region, through a second accumulator or festoon to a take-up reel.

A highly efficient, simple and yet effective coater apparatus has been designed, including a pair of troughs for receiving coating material in which a pickup roll is rotatably mounted. The pickup roll operate in close relation to a transfer or applicator roll, which rolls are positioned at generally opposed sides of the film, and somewhat intersecting the path of movement of the film, so that the film passes over the applicator roll on either side thereof with a slight wrap. The applicator roll, which turns in a direction contrary to the movement of the film, applies a measured or metered quantity of the ultraviolet coating material to the film surface. Wire wound smoothing bars are provided along the film path on either side thereof and somewhat intercepting the film path so that the film is caused to take a slight sinusoidal or zigzag path over the bars with a slight wrap about the bars. Again, the wire wound bars on either side of the film are caused to rotate in a region contra to the direction of movement of the film for providing a final smooth to the coating, and from this station, the film passes into an ultraviolet curing chamber.

There is preferably provided, for spliced film, a splice detector which is responsive to the occurrence or presence of a splice upstream of the coater. Preferably, the coater applicator rolls as well as the smoothing bars are operated on separate motors or are separately clutched from a common drive so that the rotation thereof may be controlled independently of the other segments. A microprocessor counts the position of the splice and interrupts momentarily the rotation of the applicator rolls and the rotation of the smoothing rolls in the region of the splice, as the splice moves through the coater. Since the splice region will move serially past the applicator rolls and smoothing rolls, the rotation of these rolls is interrupted serially just long enough to permit the splice to pass without application of coating material, and thereafter are automatically started up in serial fashion. Further, it has been found advantageous, on the emulsion side, to provide a solenoid-operated lifting bar, also operated by the electronic control or microprocessor, which is energized and physically lifts the emulsion side off its associated applicator roll to permit the splice to pass thereby in non-contacting relation thereto, and thereafter retracts to bring the film against the applicator roll on the emulsion side. However, it has been found not necessary to physically separate the film from the applicator roll on the non-emulsion side, but it has been found satisfactory simply to interrupt the rotation of the applicator roll as the splice region passes by.

It is accordingly an important object of this invention to provide a coater for simultaneously applying a ultraviolet curable coating to the opposite sides of film strips of indefinite length.

A further object of the invention is the provision of coating apparatus for applying an ultraviolet curable coating to spooled film consisting of individual strips of film joined by a splice including a splice detector and a control operated by said detector for interrupting the application of coating material to the splice region.

A further object of the invention is the provision of a two-sided film coater, as outlined above, which is substantially automtic in operation, and which provides for the loading of new cans of film to be coated and the off loading of coated reels of film, without interrupting the coating operation.

A still further object of the invention is the provision of a two-sided coater for applying ultraviolet curable coating materials substantially simultaneously to the opposite sides of a strip of film, including supplies of such coating material, and offset applicator rolls for applying metered quantities of coating material, followed by wire-wound rotating smoothing bars positioned to engage respective opposite sides of the film prior to entry of the film into a ultraviolet coating chamber.

These and other objects and advantages of the invention will be apparent from the following description, the accompanying drawings, and the appended claims.

DESCRIPTION OF THE PREFERRED EMBODIMENT

Figure 1:
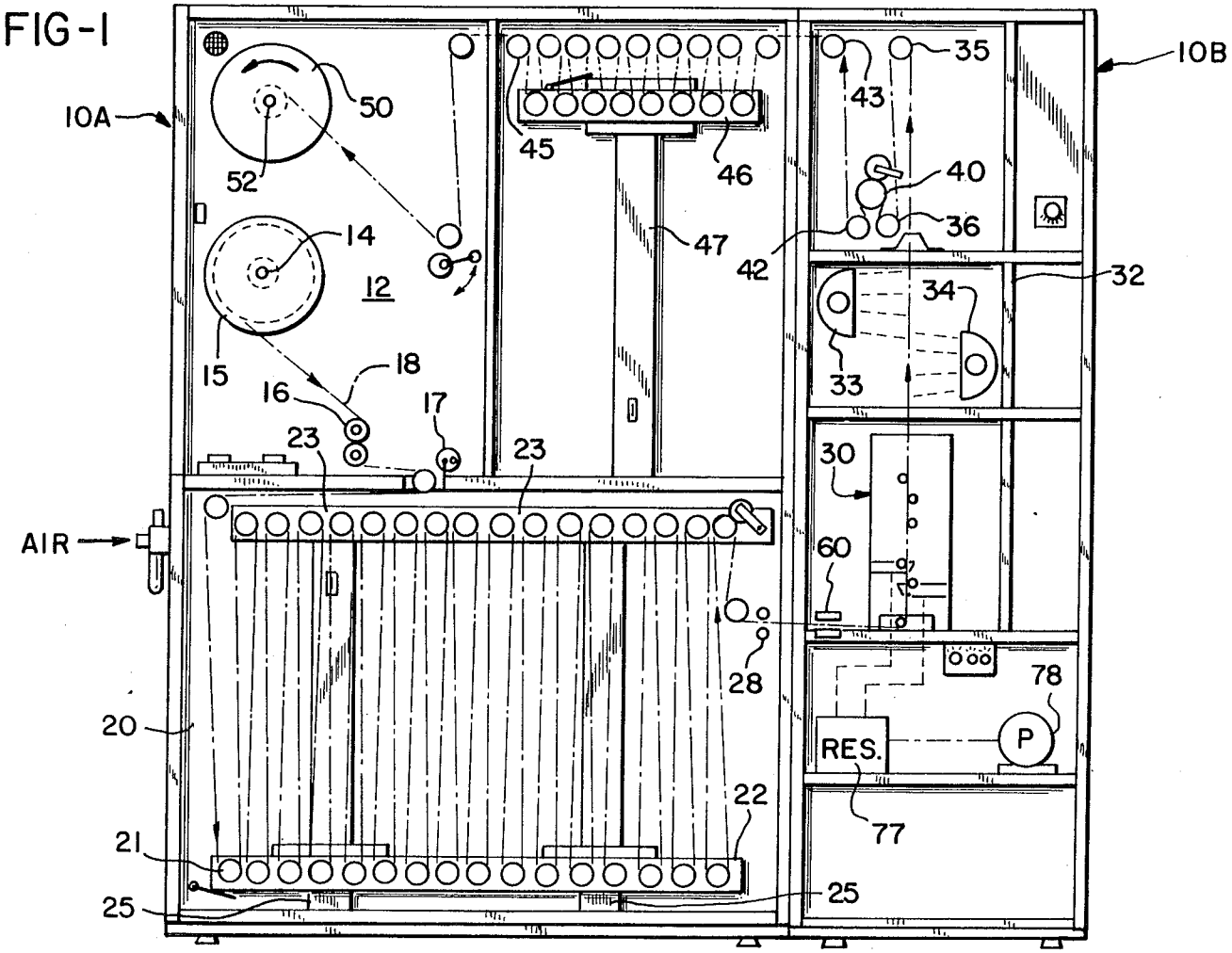
FIG. 1 is a plan view, partially diagrammatic, of a photographic film coating apparatus constructed according to this invention.

Photographic film coater apparatus according to the invention is illustrated in FIG. 1. The apparatus is particularly adapted to apply a protective coating to the surface of strip film, such as 35 millimeter film, and includes a cabinet 10 in which the entire coating apparatus may conveniently be housed. The cabinet 10 is conveniently made in two parts or sections including a section part 10*a* for film winding and unwinding operations, and a second section 10*b* for film coating and drying operations. Generally, the cabinet sections 10*a* and 10*b* are positioned in immediate adjacent relation to form a signle operative coater.

Each of the cabinet sections 10*a* and 10*b* has a back wall 12 on which is mounted the various components and parts of the apparatus. A feed or unwind spindle 14 is mounted on the wall 12 and is adapted to support a reel or spool 15 of film 18 to be coated by the coating apparatus of this invention. The uncoated strip film is joined in end-to-end relation by paper splices, which splices commonly are applied on the emulsion side of the film 18. Film is drawn from tne reel 15 through a pair of pinch rollers 16 and guide rolls 17 and into an accumulator or festoon section 20. The accumulator 20 incorporates a pair of elevators 21 and 22 which operate with a common header 23. The film is directed in serpentine relation over idler rollers 24 carried on the respective elevator sections 21 and 22 and the heater 23. The elevator sections 21 and 22 are joined together and are free to ride up or down on vertical guide rails 25, and provide the means by which a length of film 18 may be stored to permit the changing of reels 15 on the unwind spindle 14 without interrupting the operation of the coater. Normally, the elevator sections 21 and 22 will be operated at their expanded limit, as shown in FIG. 1, and provide for uninterrupted delivery of the film 18 during changing and resplicing of new reels on the feed spindle 14.

Film from the accumuluator section 20 is supplied through an air knife cleaner 28 into a coater illustrated generally at 30, described in greater detail in FIGS. 2 through 5. The coater 30 applies a uniform and smooth coating of ultraviolet curable coating material to each side of the film 18. The film 18 then moves to a ultraviolet curing chamber 32. Chamber 32 is provided with a pair of opposed ultraviolet curing lamps 33 and 34 positioned on the opposite sides of the film, for curing the coating material. The ultraviolet curing lamps 33 and 34 may be of the mercury vapor type, rated at 85 watts per inch or more, and the curing of the coated material, which may be in the order of 2 to 3 microns in thickness, is accomplished in only a few seconds. Tne film then moves to a film-receiving chamber 34 over an idlers 35 and 36 to a motor-driven drive spool 40, and an additional pair of idlers 42 and 43, to exit the coating cabinet section 10*b*.

The coated and dried film from the cabinet section 10*b* is applied to a second take-up accumulator or festoon 45, which has an elevator section 46 slidably mounted on a vertical rail 47 with respect to the header 48. The accumulator 45 provides for temporary storage of coated film during changing of a take-up reel 50 mounted on a winding spindle 52.

Figure 2:
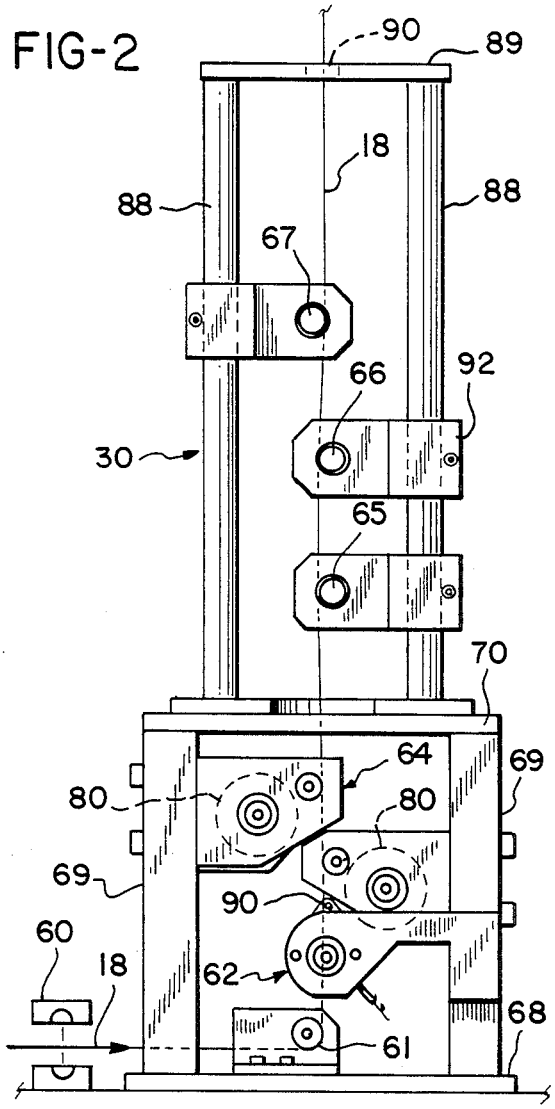
FIG. 2 is a plan view of the coating tower.
Figure 3:
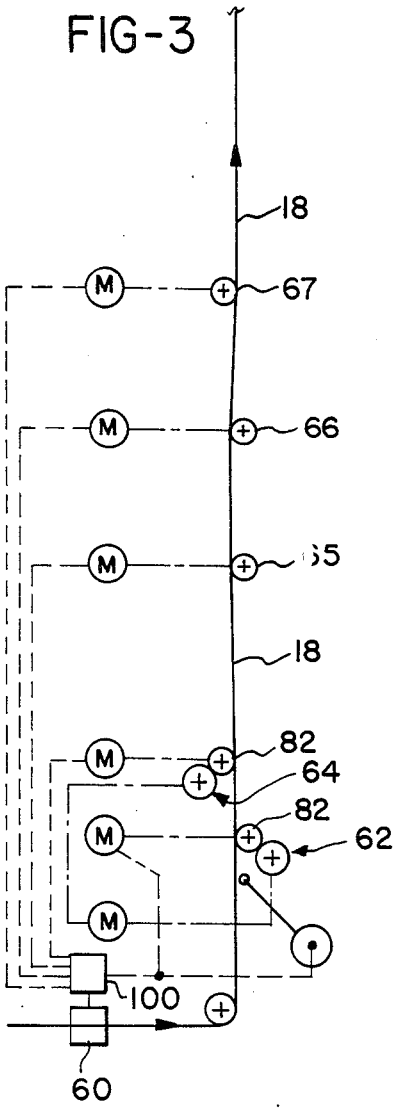
FIG. 3 is a diagrammatic representation of the tower showing schematically the motor control circuit.
Figure 4:
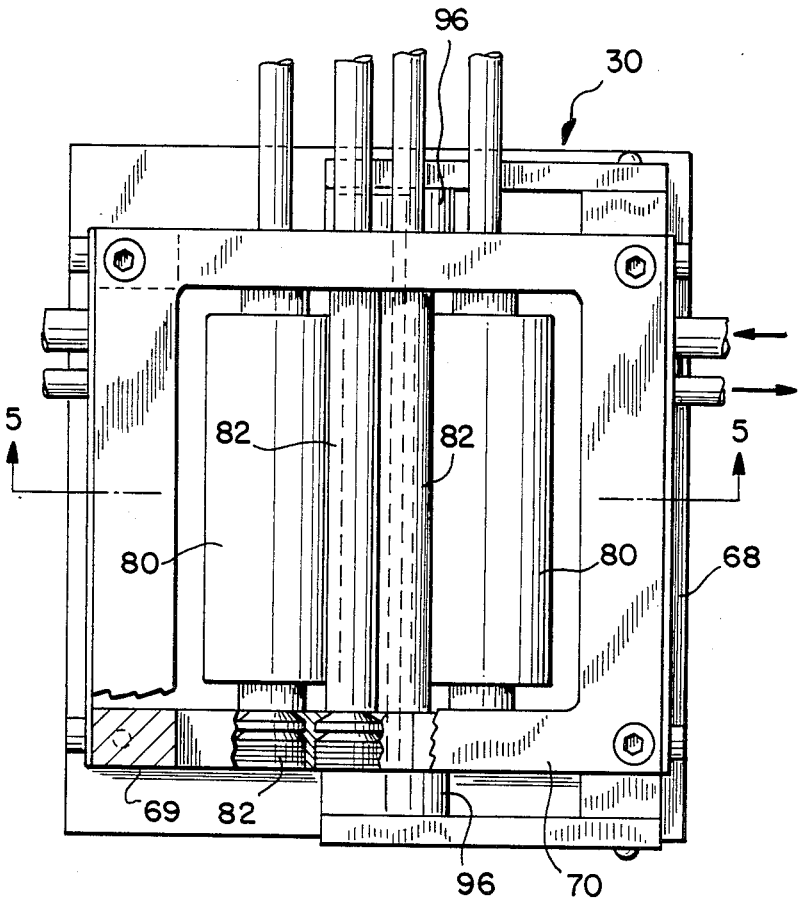
FIG. 4 is an enlarged transverse sectional view looking generally along the line 4—4 of FIG. 2.
Figure 5:
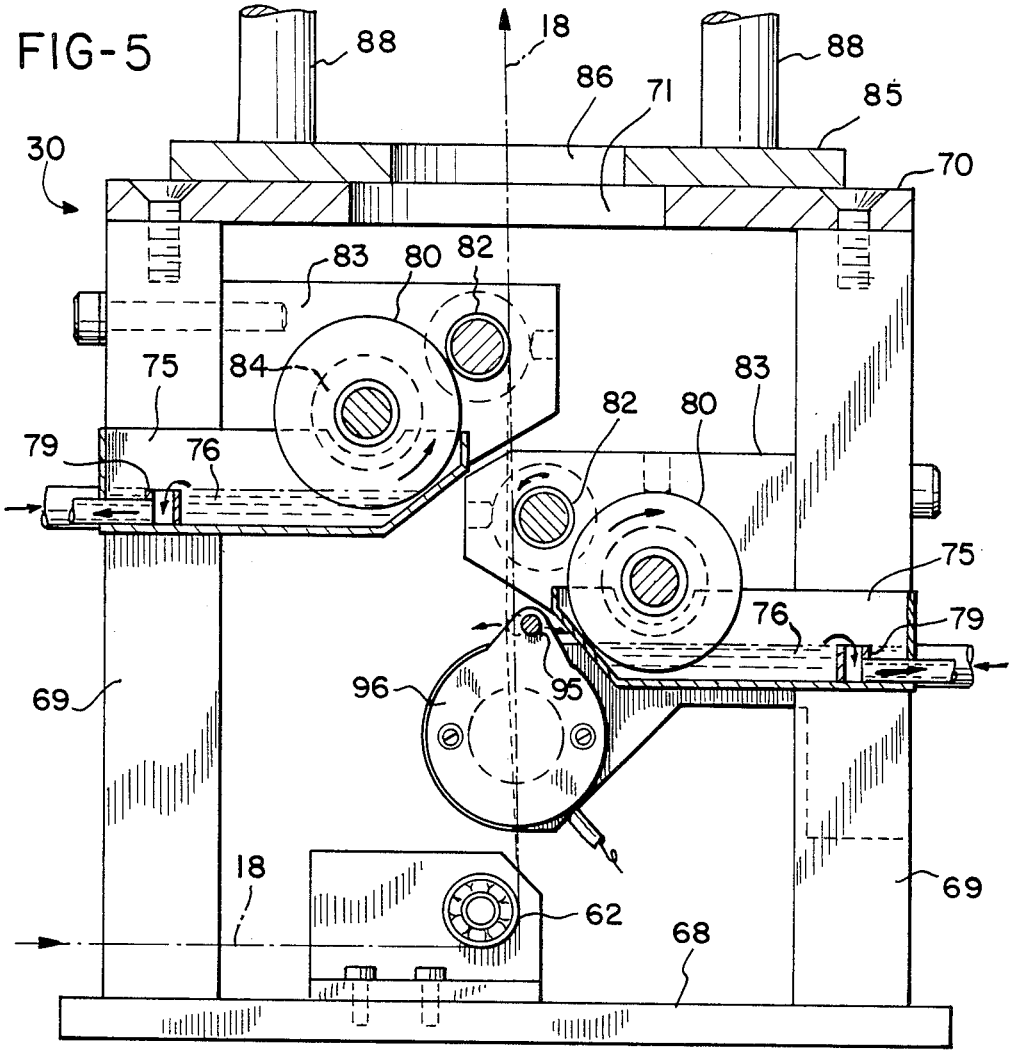
FIG. 5 is an enlarged vertical section taken generally along the line 5—5 of FIG. 4.

Reference may be had to FIGS. 2–5 for further details of the coating apparatus. The invention uses a double-sided coater which applies the liquid ultraviolet coating material in metered a measured quantity to each side of the film. A vertical and tower-like arrangement is preferred, as shown in FIG. 2. The film 18 passes through an infrared splice detector 60 to a bottom guide roll 61 and then generally upwardly through a coating tower, which includes a first applicator 62 for applying coating material to the emulsion side, and a second substantially identical applicator 64 which applies coating material to the non-emulsion side, followed by a plurality of smoothing bars 65, 66 and 67 in vertically spaced relation. Preferably, a pair of the smoothing bars 65 and 66 contact the emulsion side, but a single smoothing bar 67 may be used for contacting the non-emulsion side, as the smoothing of the coating material is not as critical on the non-emulsion side as it is on the emulsion side.

The coater applicators 62 and 64 are associated with a lower section of the coater 30, which lower section includes a base plate 68, and upstanding rectangular support bars 69 at each of the four corners thereof, supporting thereon an upper plate 70. The upper plate 70 is apertured at 71 with a slot to provide an exit opening for the film 18.

Each of the coaters or applicators 62 and 64 include an identical trough 75 for containing a quantity of coating material 76. As noted above, the coating material 76 is an ultraviolet curable polymer of the type supplied by Minnesota Minining & Manufacturing Company under the trade name "Photogard". This material has a very low rate of evaporation and therefore may be applied to an open tray such as the trough 75 with very little evaporation. The coating material 76 is applied from a reservoir of material 77 (FIG. 1) by a pump 78 to an inlet pipe opening into the bottom of each of the individual troughs 75. Stand pipes 79 are included in the bottom of the troughs and lead back to the reservoir 77, to maintain a particular height of coating material in the coating troughs.

In each of the coaters, a pickup roll 80 is rotatably mounted so that a portion extends into the liquid 76. The pickup roll operates in close but non-contacting relation to an applicator roll 82. There may, for example, be a spacing of approximately 0.002" between the applicator roll 82 and the respective pickup roll 80. The rolls 80 and 82 are mounted in end frame supports 83. The pick up rolls are also mounted on eccentric bearing 84 for making fine adjustments in spacing between the rolls to control the amount of coating material applied to the film. The respective applicator rolls 82 of each coater rotates, as indicated by the arrows on FIG. 5, in a direction contrary to the direction of the movement of the film therepast, and the film is caused to have a very slight wrap, such as from 5° to 10°, about the periphery of the applicator rolls.

The coater 30 includes an upper section consisting of a base plate 85 mounted on the top plate 70 having a central film aperture 86 and supporting four upstanding posts 88 in generally vertical relation. A cap plate 89 with a central film aperture 90 is mounted on top of the bars 88, to form the upper structure of the coating tower.

The smoothing bars 65, 66, and 67 are mounted in identical brackets 92 on pairs of tne vertical posts 88 to provide for adjustment of the vertical spacing of the smoothing bars. Tne smoothing bars are preferably wire wound in that they present to the film surface a finally grooved surface consisting of adjacent turns of fine wire which is tightly wrapped about the bars. The smoothing bars likewise turn in a direction contrary to the direction of movement of the film, for smoothing the coating applied thereto. The periphery of each of the smoothing bars extends only slightly into the path of the movement of the film, so that the film contacts the bars through a limited angular wrap or extent.

In installations and instances where continuous film is to be coated, that is, film which is free of spliced segments, the offset coating apparatus comprising the pickup and the applicator rolls, as well as the smoothing bars, may be rotated and driven by common electrical drive motors, through suitable belting. However, one of the important features of the present invention resides in the fact that provision is made for detecting the existence of a splice upstream from the coater, together with means for preventing the application of coating material to the region of the splice. In this manner, the application of coating material to the splice is avoided. This prevents the waste of coating material and prevents what can otherwise inevitable buildup of the coating material at the splice, and particularly at the region where the edge of the splice contacts the film which cannot be adequately smoothed out by the smoothing bars and which therefore presents a small portion which may not be adequately cured in the ultraviolet chamber.

For this purpose, the infrared splice detector 60 is positioned upstream of the coater apparatus, and a light beam therethrough is interrupted by the splice. The detector 60 controls the operation of a rotary solenoid-operated lifting wire 95 (FIG. 5), which is positioned on the emulsion side of the film and in normally spaced relation thereto, but which is operated through a limited arcuate movement by a pair of rotary solenoids 96 just sufficiently to contact the emulsion side of the film and lift the same off of the adjacent coating roll 82, as shown by the broken line position of the film in FIG. 5. Following the passage of the splice past the coater, the solenoids 96 are released to permit the wire to resume or return to its normal rest position shown in full lines. The rotation of the applicator rolls 82 and the smoothing bars 65–67, are interrupted in sequence, to permit the passage of the splice, followed by reactivation. The sequential operation of the solenoids 96 and the motors driving the coating rolls 82 and the smoothing bars is controlled by a simple microprocessor 100 with a plurality of timed outputs to energize the solenoids 96 and sequentially to de-energize the respective motors for the applicator rolls and the smoothing rolls.

Figure 6:
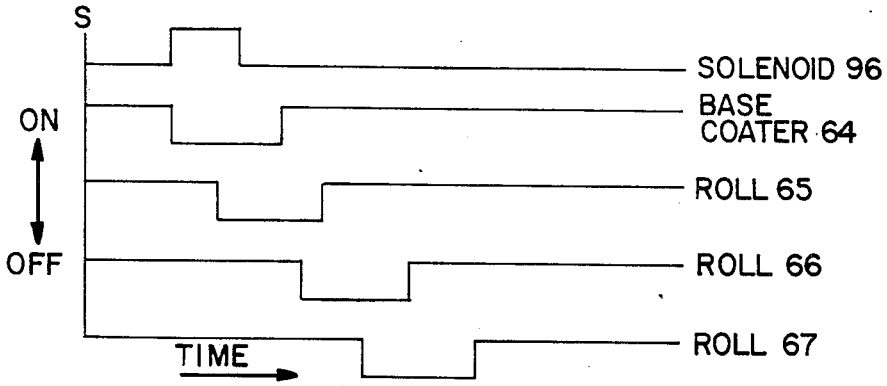
FIG. 6 is a time line diagram showing the sequence of the splice detector system.

A typical timing diagram is shown in FIG. 6 in which S represents the spliced detection by the detector 60, followed by tne timed actuation of the solenoids 96 and the deactivation of the respective drive motors concurrently with splice passage. It has been found that with respect to the applicator roll on the non-emulsion or base side, merely stopping the rotation of the applicator roll just before the splice moves therethrough, and stopping the application of the smooth roll 67, assures a minimum of contact with the coating material. However, on the emulsion side, the operation of the lifting wire 95 to divert temporarily the path of movement of the film by lifting the film physically off of its associated applicator roll on the emulsion side, followed by the sequential interruption of the rotation of the smoothing bars 65 and 66, assures that no coating will be applied to the splice region.

As noted above the coating material passes through the ultraviolet curing region as drawn therethrough by the drive motor roll 40, and is taken up through the exit elevator and wound on the take-up reel for printing. The speed of operation may be in the range of from 50 to 100 feet per minute, a somewhat slower speed being generally used where spliced film is being coated, to permit the proper timed operation of the splice detector system. Where unspliced film is being coated, higher coating rates have been achieved.

More than one smoothing bar may be used on the base side, out it has been found that a single smoothing bar provides for adequate smoothing of the coating material. Preferably, two smoothing bars are employed on the emulsion side to provide an adequately smooth coating.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. Apparatus for coating roll film, such as strips of 35 millimeter processed film connected in series by splices, with a protective ultraviolet curable coating applied to the opposite surfaces of said film strip, comprising:

means for supporting a first spool of uncoated strips of said film joined together by splices, coater means for applying said ultraviolet curable coating material to each side of said film strips, an ultraviolet curing chamber including lamp means positioned to direct ultraviolet light simultaneously to each side of said coated film strips, a take-up spool for receiving coated, cured film from said chamber, film drive means for causing said film to move from said first spool through said coater means and ultraviolet drying chamber for respooling on said take-up spool, said coater means including a pair of coater applicator rolls positioned to engage the opposite surfaces of said film strips for applying a metered quantity of said curable coating material to each of said opposite surfaces, a plurality of smoothing rods including at least one smoothing rod positioned to engage each side of said film, controllable motor means for individually driving said applicator rolls and said rods in a direction contra to the movement of said film strips thereby, a splice detector positioned upstream of said coater means to detect the passage of splices thereby, and motor control means controlled by said splice detector means for momentarily interrupting the operation of said said motor means sequentially concurrently with the passage of a detected splice past each said coater applicator rolls and said smoothing rods.

2. The coater of claim 1 in which said splices comprise paper connectors which are applied to one side of the film, and further comprising motor-operated lifter bar means positioned on said coater means immediately ahead of said applicator rolls on the side of said film strips including said splices, and operable when energized to lift said film strips off of the applicator roll normally engaging the side of said strips including said splices, said control means being connected to operate said lifter bar means for a predetermined interval coinciding with the passage of a detected splice past the associated said applicator roll to permit the detected splice to pass without having coating applied thereto.

3. A coater for coating the opposite surfaces of photographic roll film with a protective ultraviolet curable coating, comprising:

a first spindle for receiving a spool of said film, a first festoon for providing a substantial quantity of film from said spool to a coater to permit the changing of spools without interruption of the coating process, a double-sided vertical coater for receiving film from said first festoon and delivery therethrough in a generally upward direction and for applying said coating thereto, an ultraviolet curing chamber for receiving coated film from said double-sided coater having lamp means therein for applying ultraviolet light simultaneously to the opposite side of said film for curing, motor driven pinch rolls for receiving said cured film from said ultraviolet chamber, a second festoon positioned to receive film from said pinch rolls, a take-up spindle supporting a take-up spool to receive and rewind coated film passing through said second festoon, said vertical coater further including means defining a pair of troughs positioned on either side of said film for receiving quantities of said coating material, a pickup roll in each of said troughs rotatably mounted therein for receiving coating material from said troughs, each said trough further having an applicator roll positioned in close running relation to an associated said pickup roll for receiving coating material therefrom, means driving each of said applicator rolls in a direction contrary to the direction of movement of said film through said coater, each said applicator roll being positoned on opposite sides of said film for applying a controlled quantity of said coating to each surface of said film, wire-wound smoothing rolls positioned to engage the film at the opposite sides thereof as said film is drawn through said coater for smoothing the coating applied to either side thereof, and means driving said smoothing rolls in a direction contrary to the direction of movement of said film.

4. Apparatus for coating roll film, such as strips of 35 millimeter processed film connected in series by splices, with a protective ultraviolet curable coating applied to the opposite surfaces of said film strips, comprising:

a pair of coater applicator rolls positioned to engage the opposite surfaces of said film strips for applying a metered quantity of said curable coating material to each of said opposite surfaces, a plurality of smoothing rods including at least one smoothing rod positioned to engage said side of said film strips, individually controllable motor means for each of said applicator rolls and said rods for driving said applicator rolls and said rods in a direction contra to the movement of said film strips thereby, a splice detector positioned upstream of said applicator rolls to detect the passage of said splices thereby, and motor control means controlled by said splice detector means for momentarily interrupting the operation of each of said motor means sequentially concurrently with the passage of a detected splice past said coater applicator rolls and said smoothing rods, whereby said splices remain essentially free of coating.

5. The coater of claim 4 in which said splices comprise paper connectors which are applied to one side of the film, and further comprising a solenoid-operated lifter bar positioned on said coater means immediately ahead of said applicator rolls on the side of said film strips including said splices, and operable when energized to lift said film strips off of the applicator roll normally engaging the side of said strips including said splices, said control means being connected to operate said lifter bar solenoid for a predetermined interval coinciding with the passage of a detected splice past the associated said applicator roll to permit the detected splice to pass without having coating applied thereto.

6. Apparatus for coating strips of roll film, which strips are connected in series by splices, with a protective ultraviolet curable liquid coating material on the opposite surfaces of said film strips, comprising:

a coater, said coater having a pair of controllable applicator means, one each of said applicator means positioned on each side of said film strips to apply said coating material to the associated film strip side, said coater further having at least one controllable smoothing device for each of said applicators, which smoothing devices are positioned in said coater to engage one of said film strips sides for smoothing out coating material applied by the associated applicator, control means for controlling the operation of each of said applicator devices and said smoothing devices, means engaging said film strips for moving said film strips through said coater, means for detecting a splice approaching said coater, and timing means controlled by said means for detecting for temporarily rendering said applicator means inoperative and sequentially interrupting the operation of each of said smoothing means concurrently with the passage of said detected splice thereby, whereby said film strip, at the region of said splice, remains essentially free of coating material.

* * * * *